US009718081B2

(12) United States Patent
McGuffey

(10) Patent No.: US 9,718,081 B2
(45) Date of Patent: Aug. 1, 2017

(54) METERING SYSTEM FOR SIMULTANEOUSLY DISPENSING TWO DIFFERENT ADHESIVES FROM A SINGLE METERING DEVICE OR APPLICATOR ONTO A COMMON SUBSTRATE

(75) Inventor: Grant McGuffey, Springfield, TN (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 850 days.

(21) Appl. No.: 12/461,977

(22) Filed: Aug. 31, 2009

(65) Prior Publication Data

US 2011/0052811 A1 Mar. 3, 2011

(51) Int. Cl.

| | |
|---|---|
| ***B05C 5/02*** | (2006.01) |
| ***B05C 11/10*** | (2006.01) |
| *B05D 5/10* | (2006.01) |
| *B05D 1/34* | (2006.01) |

(52) U.S. Cl.

CPC ..... *B05C 5/0225* (2013.01); *B05C 5/025* (2013.01); *B05C 11/1036* (2013.01); *B05C 11/1044* (2013.01); *B05C 11/1042* (2013.01); *B05D 1/34* (2013.01); *B05D 5/10* (2013.01)

(58) Field of Classification Search

CPC . B05C 11/1044; B05C 5/0225; B05C 5/0279; B05B 7/2497; B05B 239/303–239/305; B05B 239/61; B05B 239/99; B05B 222/135; B05B 222/138; B05B 222/129; B05B 425/462; B05B 425/19; B05B 425/183; B05B 264/349

USPC ..... 427/256; 118/255, 313

See application file for complete search history.

(56) References Cited

U.S. PATENT DOCUMENTS

| | | | | |
|---|---|---|---|---|
| 2,761,791 | A * | 9/1956 | Russell | 430/502 |
| 3,159,313 | A * | 12/1964 | Guilford | 222/142 |
| 3,232,292 | A * | 2/1966 | Schaefer | 128/200.14 |
| 3,602,193 | A * | 8/1971 | Adams et al. | 118/315 |
| 3,602,947 | A * | 9/1971 | Morgan | 425/146 |
| 3,924,990 | A * | 12/1975 | Schrenk | B29C 47/0021 425/131.1 |

(Continued)

FOREIGN PATENT DOCUMENTS

| | | |
|---|---|---|
| CN | 1767891 A | 5/2006 |
| CN | 1776390 A | 5/2006 |

(Continued)

OTHER PUBLICATIONS

International Search Report for PCT/US2010/042831 dated Nov. 8, 2010.

*Primary Examiner* — Karl Kurple

(74) *Attorney, Agent, or Firm* — Levenfeld Pearlstein, LLC

(57) ABSTRACT

A new and improved hot melt adhesive or other thermoplastic material dispensing system comprises two separate and independent rotary gear-type metering pumps with two separate and independent supply sources and fluid supply passageways, or two separate and independent sets of rotary gear-type metering pumps with two separate and independent supply sources and fluid supply passageways, which are able to independently output precisely metered amounts of the hot melt adhesive materials simultaneously onto a particularly substrate through suitable output devices so as to result in a multitude of different hot melt adhesive patterns and at different locations.

10 Claims, 4 Drawing Sheets

(56) References Cited

U.S. PATENT DOCUMENTS 3,942,687 A * 3/1976 Walus ..... B05C 11/1034 222/146.5
4,076,475 A * 2/1978 Trueblood ..... 425/159
4,108,588 A * 8/1978 Fritsch ..... B29B 7/7615 210/447
4,113,182 A 9/1978 Brago
4,205,766 A * 6/1980 White ..... B65D 83/0005 222/135
4,240,566 A * 12/1980 Bergman ..... B05C 17/00516 206/219
4,274,557 A * 6/1981 Shannon ..... B67D 1/0006 137/513.7
4,323,173 A * 4/1982 Shannon ..... B67D 1/0006 137/513.7
4,396,529 A * 8/1983 Price ..... B01F 3/04446 118/300
4,420,510 A * 12/1983 Kunkel et al. ..... 427/208.2
4,476,165 A * 10/1984 McIntyre ..... 427/258
4,521,457 A * 6/1985 Russell et al. ..... 427/286
4,774,109 A * 9/1988 Hadzimihalis et al. ..... 427/286
4,778,152 A * 10/1988 Logman ..... 251/314
4,835,012 A * 5/1989 Saur ..... 427/266
4,938,994 A * 7/1990 Choinski ..... 427/96.1
4,964,732 A * 10/1990 Cadeo et al. ..... 366/152.1
5,075,139 A * 12/1991 Crumbach et al. ..... 427/286
5,129,356 A * 7/1992 Bandy et al. ..... 118/315
5,208,078 A * 5/1993 Ishibashi et al. ..... 427/483
5,501,397 A * 3/1996 Holt ..... 239/124
5,620,517 A * 4/1997 Saitoh ..... 118/41
5,700,325 A * 12/1997 Watanabe ..... 118/411
5,733,597 A * 3/1998 Schmitkons et al. ..... 427/96.4
5,772,116 A * 6/1998 Holt ..... 239/124
5,862,986 A * 1/1999 Bolyard et al. ..... 239/135
5,968,268 A * 10/1999 Kitano et al. ..... 118/52
6,037,009 A 3/2000 Clare et al.
6,089,413 A * 7/2000 Riney ..... B05B 7/0861 222/318
6,224,778 B1 * 5/2001 Peltzer ..... 210/739
6,252,129 B1 * 6/2001 Coffee ..... 602/42
6,296,463 B1 * 10/2001 Allen ..... B05B 7/0807 118/315
6,375,099 B1 * 4/2002 McGuffey ..... 239/553.5
6,422,428 B1 7/2002 Allen et al.
6,460,787 B1 * 10/2002 Hartle et al. ..... 239/691
6,467,893 B1 * 10/2002 Matsumoto et al. ..... 347/98
6,688,498 B1 * 2/2004 McGuffey ..... 222/333
6,752,323 B1 * 6/2004 Roos et al. ..... 239/63
6,837,698 B2 * 1/2005 Floyd et al. ..... 425/131.1
6,840,404 B1 * 1/2005 Schultz et al. ..... 222/61
6,890,167 B1 * 5/2005 Kwok et al. ..... 425/72.2
6,921,027 B2 7/2005 Firestone
6,936,125 B2 8/2005 Harris
6,998,087 B1 * 2/2006 Hanson et al. ..... 264/308
7,014,911 B2 3/2006 Harris
RE39,399 E * 11/2006 Allen ..... B05B 7/0861 425/192 S
7,208,721 B2 * 4/2007 Valentin et al. ..... 250/221
7,659,963 B2 * 2/2010 Kweon et al. ..... 349/189
7,765,949 B2 * 8/2010 Fork et al. ..... 118/411
7,799,371 B2 * 9/2010 Fork et al. ..... 427/115
7,810,988 B2 * 10/2010 Kamimura et al. ..... 366/160.2
7,871,058 B2 * 1/2011 Robinson et al. ..... 251/129.1
7,951,428 B2 * 5/2011 Hoerr et al. ..... 427/483
7,977,527 B2 * 7/2011 Coffee ..... 602/48
8,070,020 B2 * 12/2011 McGuffey et al. ..... 222/255
8,109,229 B2 * 2/2012 Arnaboldi ..... 118/411
8,707,891 B2 * 4/2014 Arnaboldi ..... 118/411
2001/0000611 A1 * 5/2001 Cline ..... B05B 12/1418 222/1
2001/0046551 A1 * 11/2001 Falck et al. ..... 427/8
2002/0138064 A1 9/2002 Datta et al.
2003/0062384 A1 * 4/2003 McGuffey ..... 222/109
2003/0157263 A1 * 8/2003 Walters et al. ..... 427/421
2004/0159672 A1 8/2004 Auber et al.
2004/0234698 A1 * 11/2004 Wilt et al. ..... 427/385.5
2005/0228114 A1 10/2005 Gelles
2006/0097010 A1 5/2006 Riney
2007/0071903 A1 * 3/2007 Claar et al. ..... 427/421.1
2007/0133489 A1 6/2007 Ramesh et al.
2007/0134489 A1 6/2007 Neugebauer et al.
2008/0011227 A1 * 1/2008 Arnaboldi ..... 118/255
2008/0083843 A1 * 4/2008 Nakamura et al. ..... 239/568
2008/0173728 A1 * 7/2008 Ilfrey ..... 239/74
2008/0302299 A1 12/2008 Lessley et al.
2009/0026230 A1 * 1/2009 Robinson et al. ..... 222/504
2009/0266844 A1 * 10/2009 McGuffey ..... 222/146.5
2010/0140289 A1 * 6/2010 Knobel et al. ..... 222/1
2010/0224703 A1 * 9/2010 Kwok et al. ..... 239/548
2010/0230516 A1 * 9/2010 Solie et al. ..... 239/428
2010/0270394 A1 * 10/2010 Kwon ..... 239/72
2010/0286591 A1 * 11/2010 Coffee ..... A61F 13/00063 604/20

FOREIGN PATENT DOCUMENTS

DE 102006051432 A1 5/2007
EP 0112638 A2 7/1984
EP 1421997 A1 5/2004
EP 1880772 1/2008
EP 1880772 A1 1/2008
EP 1880773 1/2008
EP 1880773 A1 1/2008
FR 2878911 A1 12/2004
JP 6132073 B2 7/1986
JP 2548547 Y2 9/1997
JP 10008705 A 1/1998
JP 3420288 B2 6/2003
WO 2008089949 A1 7/2008
WO WO 2008/089949 7/2008

* cited by examiner

METERING SYSTEM FOR SIMULTANEOUSLY DISPENSING TWO DIFFERENT ADHESIVES FROM A SINGLE METERING DEVICE OR APPLICATOR ONTO A COMMON SUBSTRATE

FIELD OF THE INVENTION

The present invention relates generally to hot melt adhesive or other thermoplastic material dispensing systems, and more particularly to a new and improved hot melt adhesive or other thermoplastic material dispensing system which comprises the utilization of two separate and independent rotary, gear-type metering pumps with two separate and independent fluid supply passages supplying two separate, different, and independent hot melt adhesives or thermoplastic materials onto a common substrate from a common or shared output device or applicator, or two separate and independent sets of rotary, gear-type metering pumps with two separate and independent fluid supply passages supplying two separate, different, and independent hot melt adhesives or thermoplastic materials, which are adapted to output or discharge precisely metered amounts of two separate and independent hot melt adhesives or other thermoplastic materials onto a common substrate from common or shared output devices or applicators respectively connected to one pump from each set of gear pumps. Furthermore, the precisely metered amounts of the hot melt adhesives or other thermoplastic materials discharged from the two separate and independent rotary gear-type metering pumps, to which have been supplied two separate, independent, and different hot melt adhesives or other thermoplastic materials, or from the two separate and independent sets of rotary gear-type pumps to which have been supplied two separate, independent, and different hot melt adhesives or other thermoplastic materials, are able to in fact be independently discharged or outputted through suitable output devices or applicators onto a common substrate so as to result in two different adhesives or other thermoplastic materials in accordance with predeterminedly required or desired patterns, or at predeterminedly required or desired locations.

Still yet further, the precisely metered amounts of the two separate, independent, and different hot melt adhesives or other thermoplastic materials which have been dispensed from the two separate and independent rotary gear-type pumps, or from the two separate and independent sets of rotary gear-type pumps, may also have their outputs effectively combined such that the discharged or outputted volumes of the hot melt adhesives or other thermoplastic materials from the common or shared output device or applicator effectively form, for example, a two-part adhesive or other construction material or composition for deposition onto the common substrate. Examples of the latter are a two-part epoxy which may comprise, for example, an adhesive and a catalyst, or a polymer and a foaming agent that can be utilized to form a suitable gasket utilized within refrigeration equipment or systems.

BACKGROUND OF THE INVENTION

In some conventional liquid metering systems, such as, for example, those outputting, discharging, or dispensing hot melt adhesives or other thermoplastic materials, it is usually the practice to output or discharge a predetermined hot melt adhesive or other thermoplastic material by pumping such materials through a pump manifold, by means of, for example, a plurality of suitable metering pumps, to one or more outlets with which suitable output devices or applicators are operatively and fluidically connected so as to deposit the particular material onto a suitable substrate in accordance with any one of several predetermined patterns. Such conventional metering systems normally comprise a motor to drive the pumps at variable rates of speed in order to achieve the desired output volumes from the pumps in order to in fact achieve the desired depositions of the materials onto the substrates. Accordingly, the speed of the motor drive, and the resulting drive of the metering pumps, can be altered depending upon, for example, the speed of the substrate as the same passes by the output devices or applicators. Depending upon the structure or configuration of the particular substrate or product onto which the hot melt adhesive or other thermoplastic material is being deposited, it is desirable to be able to apply, output, or deposit more than one type of adhesive or thermoplastic material simultaneously onto a single substrate, that is, the system must be readily capable of processing multiple types of adhesives or other thermoplastic materials. While some systems can achieve the dispensing of multiple adhesives or other thermoplastic materials by supplying these adhesives or other thermoplastic materials to multiple applicators, or where the hot melt adhesives or other thermoplastic materials are being supplied by separate metering pumps into a common applicator manifold, the pressurization and spatial limitations of such systems have effectively prevented such systems from commercially achieving such outputted, discharged, or dispensed volumes of the hot melt adhesives or other thermoplastic materials as required or desired in a viable manner. For example, in order to supply the multiple types of hot melt adhesive or other thermoplastic materials to the adhesive manifold, multiple supply hoses must effectively be connected to the adhesive manifold for each separate, independent, or different hot melt adhesive or other thermoplastic material applicator which is in fact being supplied with the particular hot melt adhesive or other thermoplastic material, to be dispensed, from the adhesive manifold. Such a system becomes excessively bulky, burdensome, and complex.

A need therefore exists in the art for a new and improved hot melt adhesive or other thermoplastic material metering system which is readily capable of metering, for example, two separate, independent, and different hot melt adhesives or other thermoplastic materials from a single hot melt adhesive or other thermoplastic material manifold to a common output device or applicator such that the required application or deposition of, for example, the two separate, independent, and different hot melt adhesives or other thermoplastic materials onto a substrate or product can be achieved at predetermined times or locations, and in accordance with predeterminedly desired or required patterns, during a product processing run or operation.

SUMMARY OF THE INVENTION

The foregoing and other objectives are achieved in accordance with the teachings and principles of the present invention through the provision of a new and improved hot melt adhesive or other thermoplastic material dispensing system which comprises the utilization of two separate and independent rotary, gear-type metering pumps with two separate and independent fluid supply passages supplying two separate, different, and independent hot melt adhesives or thermoplastic materials onto a common substrate from a common or shared output device or applicator, or two separate and independent sets of rotary, gear-type metering pumps with two separate and independent fluid supply passages supplying two separate, different, and independent hot melt adhesives or thermoplastic materials, which are adapted to output or discharge precisely metered amounts of two separate and independent hot melt adhesives or other thermoplastic materials onto a common substrate from common or shared output devices or applicators respectively connected to one pump from each set of gear pumps. Furthermore, the precisely metered amounts of the hot melt adhesives or other thermoplastic materials discharged from the two separate and independent rotary gear-type metering pumps, to which have been supplied two separate, independent, and different hot melt adhesives or other thermoplastic materials, or from the two separate and independent sets of rotary gear-type pumps to which have been supplied two separate, independent, and different hot melt adhesives or other thermoplastic materials, are able to in fact be independently discharged or outputted through suitable output devices or applicators onto a common substrate so as to result in two different adhesives or other thermoplastic materials in accordance with predeterminedly required or desired patterns, or at predeterminedly required or desired locations. Still yet further, the precisely metered amounts of the two separate, independent, and different hot melt adhesives or other thermoplastic materials which have been dispensed from the two separate and independent rotary gear-type pumps, or from the two separate and independent sets of rotary gear-type pumps, may also have their outputs effectively combined such that the discharged or outputted volumes of the hot melt adhesives or other thermoplastic materials from the common or shared output device or applicator effectively form, for example, a two-part adhesive or other construction material or composition for deposition onto the common substrate. Examples of the latter are a two-part epoxy which may comprise, for example, an adhesive and a catalyst, or a polymer and a foaming agent that can be utilized to form a suitable gasket utilized within refrigeration equipment or systems.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
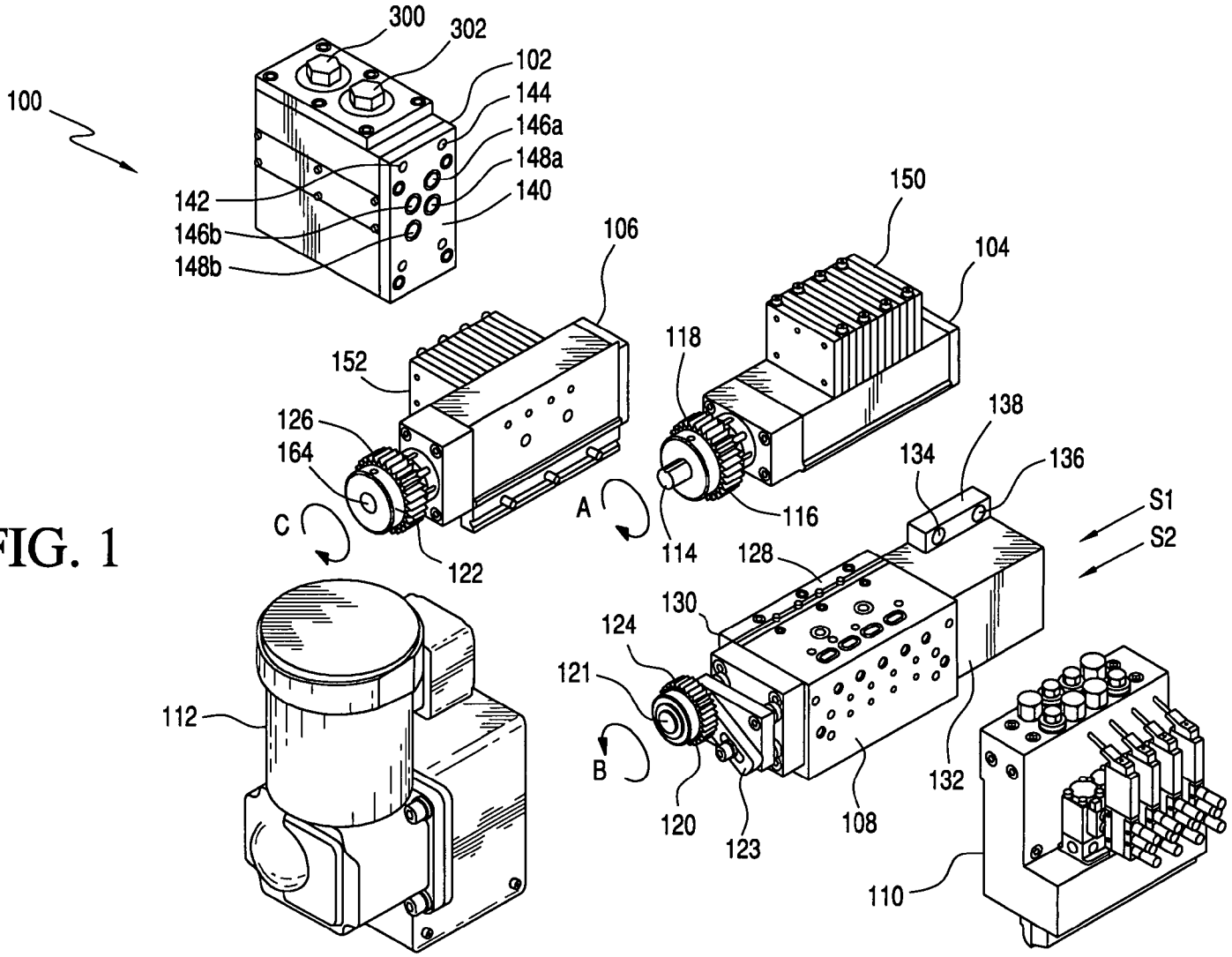
FIG. 1 is an exploded view of a new and improved metering system for dispensing, for example, two separate, independent, and different hot melt adhesives or thermoplastic materials, wherein the new and improved metering system has been constructed in accordance with the principles and teachings of the present invention, and wherein further, the outputting, discharging, or dispensing of the volumes of the two separate, independent, and different hot melt adhesives or other thermoplastic materials can be achieved in a variety of alternative or simultaneous modes of operation as required or desired.
Figure 2:
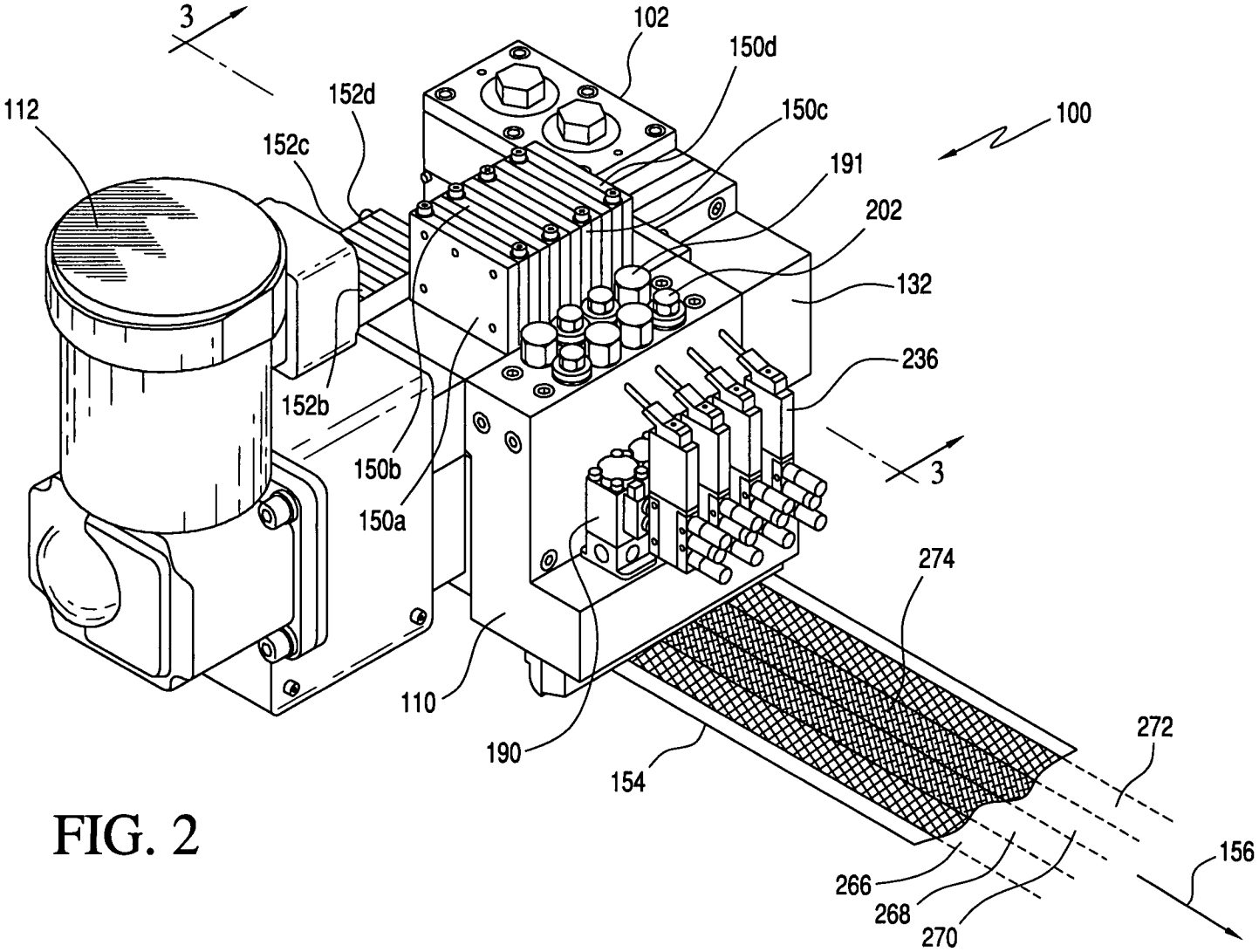
FIG. 2 is an assembled view of the various components comprising the new and improved metering system of the present invention as illustrated within FIG. 1 wherein the same effectively illustrates the use of such a metering system in connection with the discharging or dispensing of the hot melt adhesives or other thermoplastic materials onto a substrate or product passing beneath the applicators of the metering system and along a substrate or product processing line during a hot melt adhesive or other thermoplastic plastic application or dispensing operation or cycle.
Figure 3:
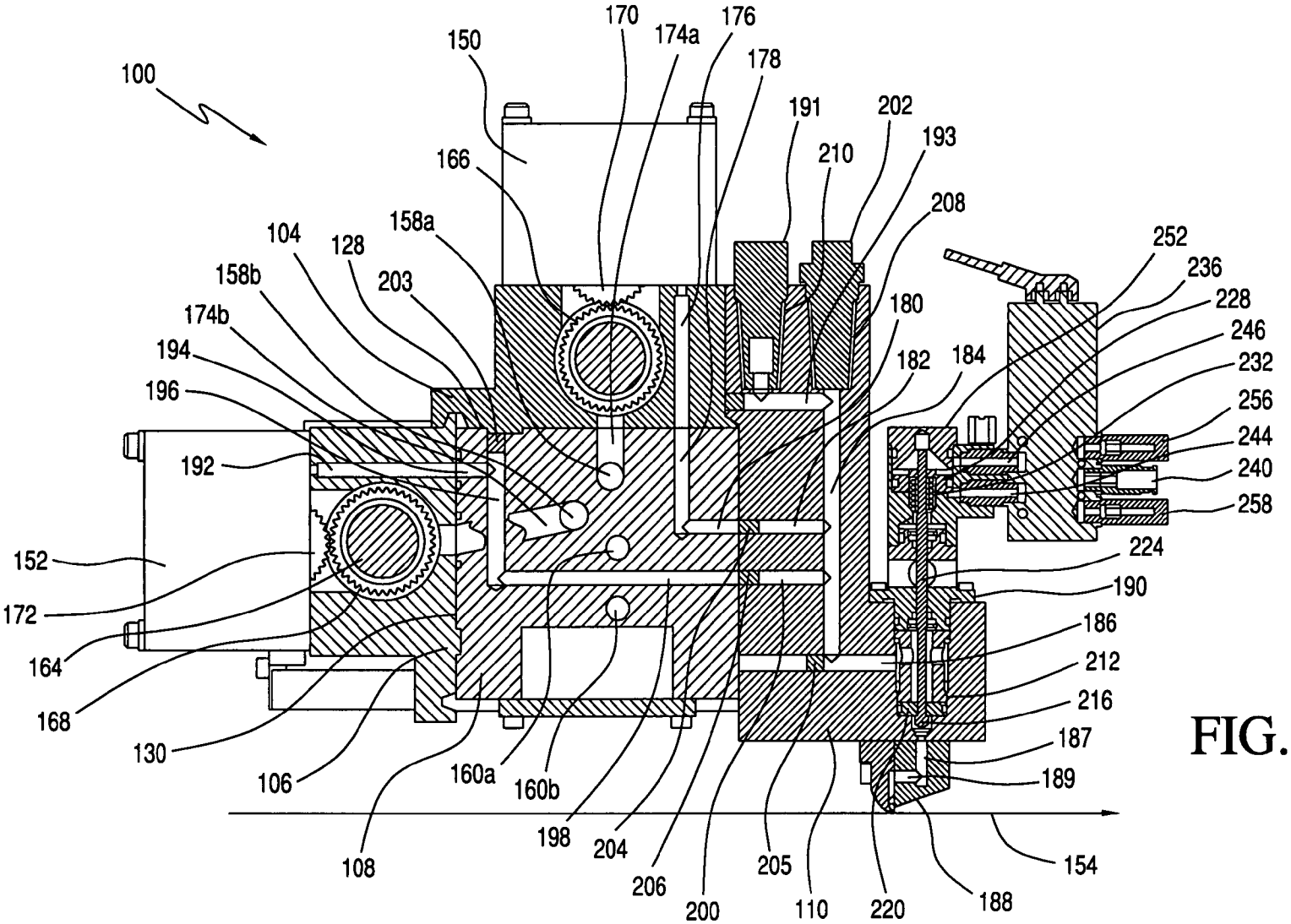
FIG. 3 is a cross-sectional view of the new and improved metering system of the present invention as has been illustrated within FIGS. 1 and 2 and as taken along lines 3-3 of FIG. 2.

Referring now to the drawings, and more particularly to FIG. 1-3 thereof, there is illustrated an embodiment of a new and improved metering system which has been constructed in accordance with the principles and teachings of the present invention and which is generally indicated by the reference character 100. More particularly, the new and improved metering system 100 is to be used to dispensing, for example, two separate, independent, and different hot melt adhesives or other thermoplastic materials from two separate and independent rotary, gear-type metering pumps with two separate and independent fluid supply passages supplying the two separate, different, and independent hot melt adhesives or thermoplastic materials onto a common substrate from a common or shared output device or applicator, or from at least two separate and independent rotary, gear-type metering pumps of two separate and independent sets of rotary, gear-type metering pumps, with two separate and independent fluid supply passages supplying the two separate, different, and independent hot melt adhesives or thermoplastic materials, onto a common substrate from respective common or shared output devices or applicators. The depositions of the hot melt adhesives or other thermoplastic materials can be achieved in simultaneous modes as considered with respect to different individual ones of the multiplicity of metering gear-type pumps of each set of rotary gear-type pumps, as well as alternative modes as considered with respect to different individual ones of the multiplicity of metering gear-type pumps of each set of rotary gear-type pumps depending upon the particular configuration of the particular set of rotary gear-type pumps, as will be more fully described hereinafter, onto an underlying substrate or product as the substrate or product passes beneath the output devices or applicators along a product processing line during a hot melt adhesive or other thermoplastic material application or dispensing operation or cycle as can be readily appreciated from FIG. 2.

Briefly, as can best be appreciated from FIG. 1, the new and improved metering system 100 of the present invention is seen to comprise a filter block 102 for filtering, for example, the two incoming supplies of hot melt adhesives or other thermoplastic materials, a first gear pump assembly 104 which comprises, for example, four rotary gear-type pumps for outputting precisely metered amounts of a first hot melt adhesive or thermoplastic material, a second gear pump assembly 106 which comprises, for example, four rotary gear-type pumps for outputting precisely metered amounts of a second hot melt adhesive or thermoplastic material, which may be different from the first hot melt adhesive or thermoplastic material, an adhesive manifold 108 for conducting the first and second hot melt adhesives or other thermoplastic materials, outputted by means of the first and second gear pump assemblies 104, 106 to a suitable output device or applicator assembly 110, and a motor drive assembly 112 operatively connected to the adhesive manifold 108 for driving gear members, not shown, of the first and second gear pump assemblies 104, 106, as will also be more specifically described hereinafter. The incoming supplies of the two hot melt adhesives or other thermoplastic materials are adapted to be fluidically connected to the adhesive manifold 108 and are accordingly schematically illustrated at S1 and S2 in FIG. 1. In addition, it is also to be appreciated that, as will be described more fully hereinafter, while each one of the first and second gear pump assemblies 104, 106 is illustrated as comprising four rotary gear-type metering pumps, the particular number of such rotary gear-type pumps comprising each one of the first and second gear pump assemblies 104, 106 may vary as required or desired.

More particularly, and with reference continuing to be made to FIG. 1, it is to be appreciated that the output drive shaft, hot shown, of the motor drive assembly 112 is adapted to be operatively connected to the drive shaft 114 of the first gear pump assembly 104 upon which the main drive gear 116 is fixedly mounted. In this manner, as the output shaft, not shown, of the motor drive assembly 112 is rotated, for example, in the clockwise (CW) direction, the drive shaft 114, and the main drive gear 116 of the first gear pump assembly 104, will likewise be rotated in the clockwise (CW) direction as indicated by means of the arrow A. The external periphery of the main drive gear 116 of the first gear pump assembly 104 is provide with a predetermined number of gear teeth 118, and it is seen that the adhesive manifold 108 is provided with an idler gear 120 which is fixedly mounted upon rotary shaft 121, while the second gear pump assembly 106 is provided with a driven gear 122, the external peripheries of the idler gear 120 and the driven gear 121 likewise being provided with a predetermined number of gear teeth 124, 126. Accordingly, as can best be appreciated from FIGS. 2 and 3, when the first gear pump assembly 104 is fixedly, but removably mounted atop the upper surface portion 128 of the adhesive manifold 108, and when the second gear pump assembly 106 is fixedly, but removably mounted upon the left side wall portion 130 of the adhesive manifold 108, the drive and driven gears 116, 122 of the first and second gear pump assemblies 104, 106 will be meshingly engaged with the idler gear 120 of the adhesive manifold 108 such that the clockwise (CW) rotation of the drive gear 116 of the first gear pump assembly 104 will effectively result in the counterclockwise (CCW) rotation of the idler gear 120 upon the adhesive manifold 108 and, in turn, the clockwise (CW) rotation of the driven gear 122 of the second gear pump assembly 106, as respectively denoted by means of the arrows B, C, whereby the first and second gear pump assemblies 104, 106 can pump hot melt adhesives or other thermoplastic materials.

It is to be further appreciated that as a result of the independent and removable mounting of the first and second gear pump assemblies 104, 106 upon the adhesive manifold 108, each one of the gear pump assemblies 104, 106 may be independently removed from the adhesive manifold 108 with respect to the other one of the gear pump assemblies 104, 106 for the purposes of repair, maintenance, or to replace a particular one of the gear pump assemblies 104, 106 with a different gear pump assembly having, for example, a different volumetric output rating. Still further, it is also to be appreciated that as a result of the main drive gear 116 of the first gear pump assembly 104 having a predetermined number of external gear teeth 118, and, in a similar manner, as a result of the idler gear 120 of the adhesive manifold 108 and the driven gear 122 of the second gear pump assembly 106 also having a predetermined number of external gear teeth 124, 126, a predetermined drive ratio is effectively established between the gear teeth 118 of the drive gear 116 and the gear teeth 124, 126 of the idler and driven gears 120, 122 such that the gear pump assemblies 104, 106 have predetermined volumetric output ratings. However, it is to be additionally appreciated that the particular volumetric output rating of a particular one of the gear pump assemblies 104, 106 may be changed or altered by providing one or both of the gear pump assemblies 104, 106 with a different drive and driven gear 116, 22 having a different number of gear teeth 118, 126, that would then, in effect, change or alter the drive gear ratio effectively defined between that particular drive gear 116 and the driven gear 122, of the first and second gear pump assemblies 104, 106, as well as with respect to the idler gear 120 of the adhesive manifold 108. Depending upon whether a larger or smaller drive gear 116 is mounted upon the first gear pump assembly 104, or whether a larger or smaller driven gear 122 is mounted upon the second gear pump assembly 106, the angular and linear disposition of the idler gear 120 upon the adhesive manifold 108 may be altered by means of a slotted arm or bracket 123.

It is lastly noted, with respect to the structural arrangement of the various components of the metering system 110 as disclosed within FIG. 1, that the filter block 102 is adapted to be fixedly mounted upon the end of the adhesive manifold 108 opposite the end at which the idler gear 120 is located. In order to accommodate or facilitate the mounting of the filter block 102 upon such opposite end of the adhesive manifold 108, the adhesive manifold 108 is provided with an integral mounting block 132, and it is seen that a pair of apertures 134, 136 are formed within an upper flanged portion 138 of the mounting block 132 for accepting or accommodating suitable mounting bolts, not shown.

In a similar manner, the side wall portion or face 140 of the filter block 102 is likewise provided with a pair of apertures 142, 144 for accepting or accommodating the mounting bolts, not shown. In addition, the side wall portion or face 140 of the filter block 102 is also provided with a pair of outlet passageways 146*a*, 146*b* for supplying, for example, the two different hot melt adhesives or other thermoplastic materials, toward and into the adhesive manifold 108, and a pair of inlet passageways 148*a*, 148*b* for permitting recirculated hot melt adhesive or other thermoplastic material to be conducted back from the adhesive manifold 108 and into the filter block 102, whereby the recirculated hot melt adhesive or other thermoplastic material can once again be conducted outwardly from the filter block 102 and toward the adhesive manifold 108 through means of the outlet supply passageways 146*a*, 146*b*. It will be recalled that the original supplies of, for example, the two different hot melt adhesives or other thermoplastic materials are originally fluidically conducted into the adhesive manifold by means of the suitable conduits schematically illustrated at S1 and S2.

As was noted hereinabove, each one of the pair of gear pump assemblies 104, 106 respectively comprises a predetermined number of gear pumps 150, 152. In the illustrated embodiment, the number of gear pumps 150, 152 comprising each one of the gear pump assemblies 104, 106 is four, however, this number can be more than four or less than four as may be desired or required in connection with a particular substrate or product processing line. Accordingly, with reference now being made to FIG. 3, the fluid flow paths for a particular one of the gear pumps 150, 152 of the first and second gear pump assemblies 104, 106, through the adhesive manifold 108 and through the output device or applicator 110, so as to be outputted, discharged, or dispensed onto the substrate or product 154 being conveyed beneath the output device or applicator 110 along a product processing line 156, schematically illustrated within FIG. 2, will now be described. More particularly, with reference being made to FIG. 3, the adhesive manifold 108 is illustrated as having the first gear pump assembly 104, comprising a particular one of its gear pumps 150, fixedly but removably mounted upon the upper surface portion 128 thereof, while the second gear pump assembly 106, comprising a particular one of its gear pumps 152, is fixedly but removably mounted upon the left side wall portion 130 thereof. The adhesive manifold 108 is provided with a pair of axially extending fluid supply passageways 158*a*, 158*b* which are respectively adapted to be fluidically connected to the hot melt adhesive or other thermoplastic material supply output passageways 146*a*, 146*b* defined within the filter block 102, as illustrated within FIG. 1, and is also provided with a pair of axially extending fluid return or recirculation passageways 160*a*, 160*b* which are adapted to be fluidically connected to the hot melt adhesive or other thermoplastic material inlet passageways 148*a*, 148*b* defined within the filter block 102, as is also illustrated within FIG. 1.

It will be further appreciated from FIG. 1 that the drive gear 116 and the driven gear 122, respectively associated with the gear pump assemblies 104, 106 and respectively driven by means of the drive motor assembly 112 and the enmeshed engagement with the idler gear 120 disposed upon the rotary shaft 121 of the adhesive manifold 108, are respectively mounted upon their rotary shafts 114, 164 which are illustrated within both FIGS. 1 and 3. The shafts 114, 164 have, in turn, drive gears 166, 168 fixedly mounted thereon and disposed internally within the gear pump assemblies 104, 106, and the drive gears 166, 168 are, in turn, enmeshed with gear pump driven gears 170, 172 of gear train assemblies respectively disposed internally within each one of the gear pumps 150, 152. Accordingly, the supply of the hot melt adhesive or other thermoplastic material is supplied from the supply outlet passageways 146*a*, 146*b* of the filter block 102, into the supply passageways 158*a*, 158*b* of the adhesive manifold 108, and with respect to the use or functioning of a particular gear pump 150, when the same is to be used to pump a first one of, for example, the two different hot melt adhesives or other thermoplastic materials from the supply source S1, such first one of the two different hot melt adhesives or other thermoplastic materials will be conducted into, for example, the annular space surrounding the outer periphery of the adhesive manifold drive gear 166 by means of a connecting fluid supply passageway 174*a* which extends upwardly within the adhesive manifold 108 and into the lower or bottom portion of the gear pump assembly 104. A similar connecting fluid supply passageway 174*b* is of course provided internally within the adhesive manifold 108, in connection with the particular gear pump 152, and such passageway 174*b* extends leftwardly into the right end portion of the gear pump assembly 106, as viewed within FIG. 3, so as to introduce, for example, the second one of the hot melt adhesives or other thermoplastic materials into the annular space surrounding the outer periphery of the adhesive manifold drive gear 168.

Reverting back to the gear pump 150, the fluid output of the gear train, internally disposed within the gear pump 150 and including the gear pump driven gear 170, is conducted outwardly from the gear pump 150 by means of a first vertically oriented output supply passageway 176, which extends downwardly through the gear pump assembly 104, and a second vertically oriented output supply passageway 178 which is fluidically connected to the downstream end of the first vertically oriented output supply passageway 176 and which is defined within the adhesive manifold 108. The downstream end of the second vertically oriented output supply passageway 178 is, in turn, fluidically connected to the upstream end of a third horizontally oriented output supply passageway 180 which is defined within the adhesive manifold 108, and the downstream end of the third horizontally oriented output supply passageway 180 is, in turn, fludically connected to an upstream end of a fourth horizontally oriented output supply passageway 182 which is defined within the output device or applicator 110. A fifth vertically oriented output supply passageway 184 has a central portion thereof fluidically connected to the downstream end portion of the fourth horizontally oriented output supply passageway 182, and the downstream end portion of the fifth vertically oriented output supply passageway 184 is fluidically connected to a central portion of a sixth horizontally oriented output supply passageway 186 which is also defined within the output device or applicator 110. Still further, it is seen that the downstream end portion of the sixth horizontally oriented output supply passageway 186 is fluidically connected to a dispensing nozzle member 188, disposed upon the underside portion of the output device or applicator 110, through the intermediary of an electrically controlled, solenoid-actuated control valve assembly 190, the detailed structure of which will be provided shortly hereinafter.

The valve-controlled output of the electrically controlled, solenoid-actuated control valve assembly 190 is actually fluidically connected by means of a seventh vertically oriented output supply passageway 187 and an eighth horizontally oriented output supply passageway 189 which actually leads to the output port of the dispensing nozzle member 188. Lastly, it is seen that the central portion of the fifth vertically oriented output supply passageway 184 is also fluidically connected to a pressure relief valve assembly 191, which is disposed within a bore 210 of the output device or applicator 110, through means of a ninth horizontally oriented fluid passageway 193, so as to effectively define a return flow path for the hot melt adhesive or other thermoplastic material in a direction which is opposite that of the supply flow of the hot melt adhesive or other thermoplastic material and which leads toward the electrically controlled solenoid-actuated control valve assembly 190 and the dispensing nozzle member 188, as will be described more particularly hereinafter. The hot melt adhesive or other thermoplastic material is effectively vented and returned to the first hot melt adhesive or other thermoplastic material supply source S1, through means of the pressure relief valve assembly 191, when the electrically controlled solenoid-actuated control valve assembly 190 is moved to its CLOSED position such that no further dispensing of the hot melt adhesive or other thermoplastic material out from the dispensing nozzle member 188 is permitted.

In a similar manner, it is likewise to be appreciated that the fluid output of the gear train, internally disposed within the gear pump 152 and including the gear pump driven gear 172, is conducted outwardly from the gear pump 152 by means of a first horizontally oriented output supply passageway 192, which extends horizontally through the gear pump assembly 106, and a second horizontally oriented output supply passageway 194 which is fluidically connected to the downstream end portion of the first horizontally oriented output supply passageway 192 and which is defined within the adhesive manifold 108. The downstream end portion of the second horizontally oriented output supply passageway 194 is, in turn, fluidically connected to the upstream end of a third vertically oriented output supply passageway 196 which is also defined within the adhesive manifold 108, and the downstream end portion of the third vertically oriented output supply passageway 196 is, in turn, fluidically connected to the upstream end portion of a fourth horizontally oriented output supply passageway 198 defined within the adhesive manifold 108. A fifth horizontally oriented output supply passageway 200, defined within the upper left central portion of the output device or applicator 110, has its upstream end portion fluidically connected to the downstream end portion of the fourth horizontally oriented output supply passageway 198, while the downstream end portion of the fifth horizontally oriented output supply passageway 200 is fluidically connected to a substantially central portion of the fifth vertically oriented output supply passageway 184 in a manner similar to the fluidic connection of the fourth horizontally oriented output supply passageway 182 operatively associated with the gear pump 150.

As has been noted, the downstream end portion of the fifth vertically oriented output supply passageway 184 is fluidically connected to a central portion of a sixth horizontally oriented output supply passageway 186 that is defined within the output device or applicator 110 and ultimately leads to the dispensing nozzle 188, however, it is also seen that the opposite end of the fifth vertically oriented output supply passageway 184 is fluidically connected to, and effectively terminates at a pressure relief plug 202 disposed within a bore 208. The reason for this is that when the first hot melt adhesive or other thermoplastic material, supplied from the first supply source S1, is being pumped by means of one of the pumps 150 of the first gear pump assembly 104 so as to be discharged or dispensed out from the associated dispensing nozzle 188, its associated one of the pumps 152 of the second gear pump assembly 106, which would normally be receiving a supply of the second hot melt adhesive or other thermoplastic material from the second supply source S2, is not being used, is not in fact receiving a supply of the second hot melt adhesive or other thermoplastic material from the second supply source S2, and is intended to be removed from the second gear pump assembly 106. Accordingly, since none of the second hot melt adhesive or other thermoplastic material is being pumped from this particular one of the four pumps 152 comprising the second gear pump assembly 106, the plug 202 is used to effectively close off that upper end portion of the fifth vertically oriented output supply passageway 184 which is adapted to be fluidically connected back to the supply source S2. On the other hand, since the first hot melt adhesive or other thermoplastic material is being pumped by means of the particular one of the pumps 150 of the first gear pump assembly 104, when the electrically controlled solenoid-actuated control valve assembly 190 is moved to its CLOSED position such that no further dispensing of the hot melt adhesive or other thermoplastic material, pumped by means of the particular gear pump 150 of the first gear pump assembly 104 to the dispensing nozzle member 188, is permitted, the first hot melt adhesive or other thermoplastic material is able to effectively be returned or vented to the first hot melt adhesive or other thermoplastic material supply source S1 through means of the pressure relief valve assembly 191.

It is to be further understood that the converse situation is similarly true, that is, when the particular one of the gear pumps 152 is pumping the second hot melt adhesive or other thermoplastic material toward the dispensing nozzle member 188, and its associated gear pump 150 of the first gear pump assembly 104 is not being used and has been removed from the first gear pump assembly 104, the pressure relief valve assembly 191 is now located at the position at which the plug 202 is illustrated, that is, within bore 208, and the plug 202 is located at the position at which the pressure relief valve 191 is illustrated, that is, within bore 210. In this manner, when the electrically controlled solenoid-actuated control valve assembly 190 is moved to its CLOSED position such that no further dispensing of the hot melt adhesive or other thermoplastic material, pumped by means of the particular gear pump 152 of the second gear pump assembly 106 to the dispensing nozzle member 188, is permitted, the second hot melt adhesive or other thermoplastic material is able to effectively be vented and returned to the second hot melt adhesive or other thermoplastic material supply source S2 through means of the pressure relief valve assembly 191.

With reference continuing to be made to FIG. 3, it is also noted that, depending upon the particular pattern or location at which it is desired to deposit one of the two separate, independent, and different hot melt adhesive or other thermoplastic materials onto the underlying substrate or product, and has just been effectively described, different ones of, for example, the four particular pumps 150, 152 of the first and second gear pump assemblies 104, 106 will be utilized at a particular time during the hot melt adhesive or other thermoplastic deposition process, operation, or operative cycle. In connection with the use of particular ones of the pumps 150, 152 of the first and second gear pump assemblies 104, 106, it is to be appreciated that pairs of pumps 150, 152 of the first and second gear pump assemblies 104, 106 will effectively share the same output device or applicator 188. In connection with the particular ones of, for example, the four pumps 150, 152 of the first and second gear pump assemblies 104, 106 that will or will not be used, a pair of plugs, such as, for example, illustrated at 204, 206 can be respectively installed within, for example, the output supply passageways 182, 200 in order to effectively block or restrict fluid flow from that particular output supply passageway 182, 200. As has also been noted, in conjunction with the plugs 204, 206, the particular one of the pumps 150, 152 which is not being used to pump either the first or second hot melt adhesive or other thermoplastic material will preferably have been removed from its first or second gear pump assembly 104, 106.

Figure 4:
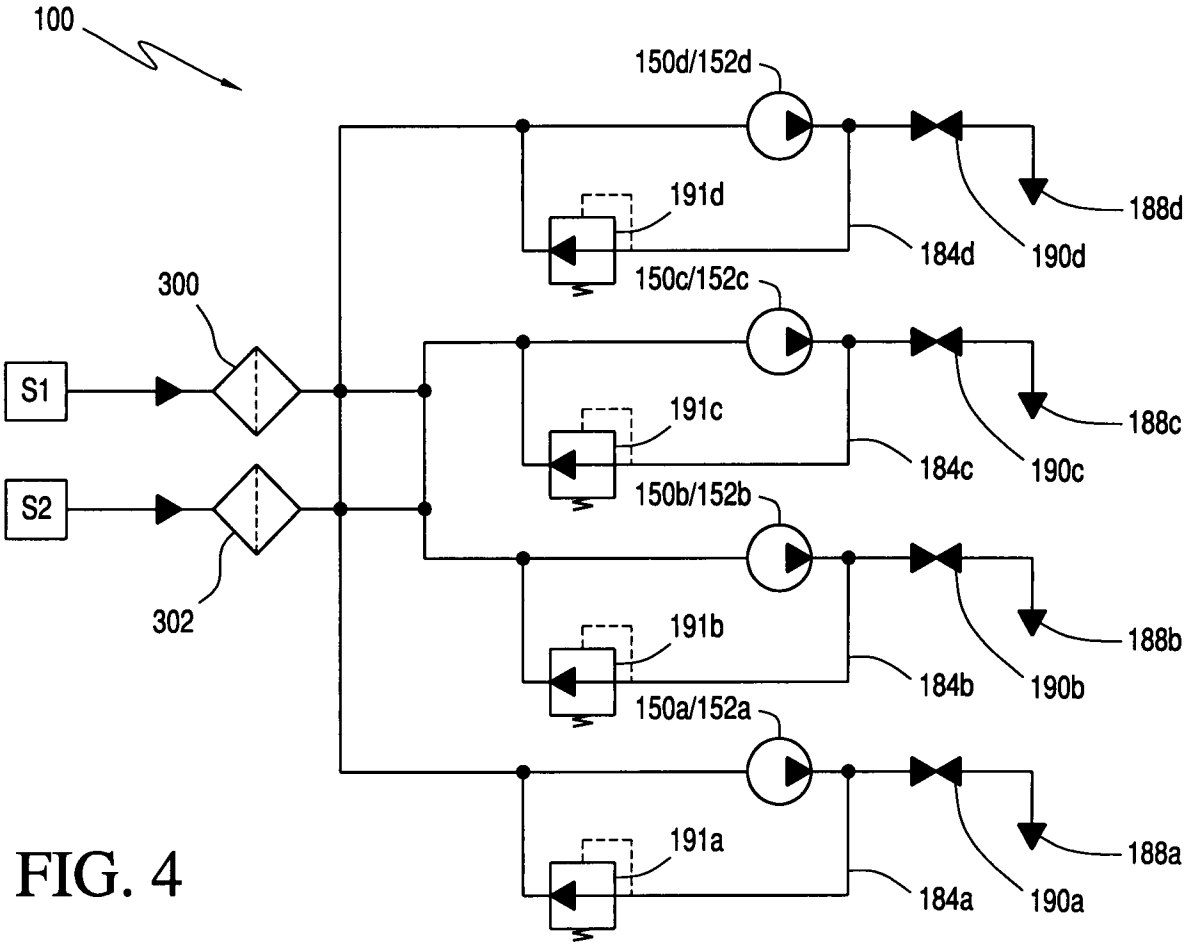
FIG. 4 is a schematic hydraulic flow circuit diagram illustrating one mode of configuring the various different hydraulic connections and flow paths defined between the various structural components of the new and improved metering system of the present invention as illustrated within FIGS. 1-3 whereby, for example, different pumps from the two different sets of gear pump assemblies can dispense from different output devices or applicators.

Accordingly, depending upon the particular placement of the plugs 204, 206 within the aforenoted output supply passageways, two different pumps from the first and second gear pump assemblies 150, 152 can discharge their outputted hot melt adhesives or other thermoplastic materials in an alternative mode through the same dispensing nozzle 188, or through separate and independent dispensing nozzles 188 as will be more fully described in connection with FIG. 4. Still further, the two different pumps from the first and second gear pump assemblies 150, 152 can simultaneously discharge their outputted hot melt adhesives or other thermoplastic materials through the same dispensing nozzle 188 if, for example, it is desired to combine the two hot melt adhesives or other thermoplastic materials, such as, for example, when a two-part adhesive or other thermoplastic material is to be deposited upon the substrate or product. Examples of such comprise a two-part epoxy comprising, for example, an adhesive and a catalyst, or a polymer and a foaming agent that can be utilized to form a suitable gasket utilized in refrigeration equipment or systems. It is also noted that additional permanent plugs 203, 205 are respectively disposed in the third vertically oriented output supply passageway 196 and the sixth horizontally oriented output supply passageway 186, respectively defined within adhesive manifold 108 and the output device or applicator 110 so as to permanently block off the upstream end portions of such output supply passages such that there is no leakage of the hot melt adhesive or other thermoplastic material.

Lastly, as has been described hereinbefore, a description of the electrically controlled, solenoid-actuated control valve assembly 190 will no be briefly described. The output device or applicator 110 is provided with a bore 212 within which the valve mechanism, comprising a ball valve member 216, is adapted to be disposed. The ball valve member 216 is adapted to engage an underside portion of a valve seat member 220 when the ball valve member 216 is disposed at its raised, CLOSED position, and it is further seen that the ball valve member 216 is fixedly mounted upon the lower end portion of a vertically oriented valve stem 224. The upper end portion of the valve stem 224 is fixedly mounted within a piston member 228, and the piston member 228 is normally biased or assisted toward its raised or uppermost position by means of a coil spring 232. The electrically controlled, solenoid-actuated control valve assembly 190 further comprises a solenoid actuator 236 and a control air inlet port 240. The control air inlet port 240 is fluidically connected to a pair of control air outlet ports 244, 246 by means of a fluid passageway disposed internally within the solenoid actuator 236 but not shown for clarity purposes. The control air outlet ports 244, 246 fluidically connect the solenoid actuator 236 to the piston housing 252 of the valve assembly 190 and it is to be understood or appreciated that the solenoid actuator 236 comprise suitable valve mechanisms disposed internally thereof, but not shown for clarity purposes, which will respectively control the flow of the incoming control air from control air inlet port 240 to one of the control air outlet ports 244, 246. In this manner, the control air can, in effect, act upon the top surface portion or the undersurface portion of the piston member 228 and thereby control the vertical disposition of the piston member 228 that, in turn, will control the disposition of the ball valve member 216 with respect to its valve seat 220. Accordingly, the ball valve member 216 will alternatively be disposed at and define CLOSED or OPENED states which will respectively prevent the flow of the hot melt adhesive or other thermoplastic material toward the dispensing nozzle member 188, or will permit the flow of the hot melt adhesive or other thermoplastic material toward the dispensing nozzle member 188. Lastly, a pair of mufflers 256, 258 are operatively associated with the control air inlet 240 so as to effectively muffle the sound of exhausted control air when the piston member 228 is moved between its upper and lower positions so as to respectively move the ball valve member 216 between its CLOSED or OPENED positions.

Having described substantially all of the structural components of the new and improved metering system 100 of the present invention, a brief description of one particular mode of operation of the new and improved metering system 100 of the present invention will now be described with reference being made primarily to FIG. 4 but also in connection with FIG. 2. With reference therefore being made to FIG. 4, it is seen that, for example, the two separate, independent, and different hot melt adhesives or other thermoplastic materials are supplied into the new and improved metering system 100 from the supply sources S1, S2 and that the hot melt adhesives or other thermoplastic materials respectively pass through a pair of filter members 300, 302 respectively disposed within the filter block 102. From the filter members 300, 302, it is seen that the two separate, independent, and different hot melt adhesives or other thermoplastic materials from the supply sources S1, S2 are supplied to, for example, gear pumps 150*a*, 150*b*, 150*c*, 150*d* of the first gear pump assembly 104, as well as to, for example, gear pumps 152*a*, 152*b*, 152*c*, 152*d* of the second gear pump assembly 106.

It is further seen that the output supplies of the hot melt adhesives or other thermoplastic materials from the gear pumps 150*a*, 150*b*, 150*c*, 150*d* are respectively conducted toward the dispensing nozzles 188*a*, 188*b*, 188*c*, 188*d* along the respective output supply passageways disclosed and described in connection with FIG. 3 and through means of the electrically controlled, solenoid-actuated control valves 190*a*, 190*b*, 190*c*, 190*d*. In a similar manner, the output supplies of the hot melt adhesives or other thermoplastic materials from the gear pumps 152*a*, 152*b*, 152*c*, 152*d* are likewise conducted toward the dispensing nozzle members 188*a*, 188*b*, 188*c*, 188*d* along the various output supply passageways likewise disclosed and described in connection with FIG. 3 and by means of the electrically controlled, solenoid-actuated control valves 190*a*, 90*b*, 190*c*, 190*d*. It is to be recalled that the particular hot melt adhesive or other thermoplastic material flowing from the separate, independent, and different sources S1, S2 will only be pumped by means of the particular pumps 150*a*, 152*a*, 50*b*, 152*b*, 150*c*, 152*c*, 150*d*, 152*d*, and conducted to the particular output device or applicator 188*a*, 188*b*, 188*c*, 188*d* depending upon whether or not one of the configuration plugs 204, 206 has been installed within a respective one of the supply passageways 182, 200 operatively and fluidically associated with particular ones of the pumps 150*a*, 152*a*, 150*b*, 152*b*, 150*c*, 152*c*, 150*d*, 152*d*.

It can therefore be appreciated that when, for example, the electrically controlled, solenoid-actuated control valve 190*a* is moved to its CLOSED position, the output supply of the hot melt adhesive or other thermoplastic material from the one of the pair of gear pumps 150*a*/152*a* that has been pumping its hot melt adhesive or other thermoplastic material, as permitted by means of the aforenoted configuration plugs 204, 206, will effectively be blocked and shuttled into the flow path 184*a* so as to be conducted out through the pressure relief valve 191*a* and one of the return or recirculation path 160*a*/160*b*, as disclosed within FIG. 3, for return back to one of the filter members 300 or 302 of the filter block 102. Similarly, when, for example, the electrically controlled solenoid-actuated control valve 190*b* is moved to its CLOSED position, the output supply of the hot melt adhesive or other thermoplastic material from one of the gear pumps 150*b*/152*b*, again depending upon the particular location of the configuration plugs, will effectively be blocked and shuttled into the flow path 184*b* so as to be conducted out through the pressure relief valve 191*b* and one of the return or recirculation paths 160*a*, 160*b*, as disclosed within FIG. 3, for return back to one of the filter members 300 or 302 of the filter block 102. Similar operations and fluid flows of the hot melt adhesives or other thermoplastic materials can of course be readily accomplished in connection with gear pumps 150*c*, 152*c*, and pumps 150*d*, 152*d*, electrically controlled, solenoid-actuated control valves 190*c*, 190*d*, and pressure relief valves 191*c*, 191*d*. It is to be appreciated that since all of the gear pumps 150 within the first gear pump assembly 104 are supplied with the hot melt adhesive or other thermoplastic material from the first supply source S1, all of the hot melt adhesive or other thermoplastic material being recirculated or returned back to the first supply source S1 from all of the gear pumps 150 comprising the first gear pump assembly 150 is in fact recirculated or returned by means of the common return or recirculation flow path 160*a*. Similarly, with respect to all of the gear pumps 152 comprising the second gear pump assembly 106, that is, all of the hot melt adhesive or other thermoplastic material being recirculated or returned back to the second supply source S2 from all of the gear pumps 152 comprising the second gear pump assembly 152 is in fact recirculated or returned by means of the common return or recirculation flow path 160*b*.

It can be further appreciated that by means of the new and improved metering system 100, as constructed in accordance with the principles and teachings of the present invention, the output or dispensing of the hot melt adhesives or other thermoplastic materials, from the dispensing nozzle members 188*a*, 188*b*, 188*c*, and 188*d*, for the discharge, dispensing, or deposition of the hot melt adhesives or other thermoplastic materials onto the substrate or product 154 as illustrated within FIGS. 2 and 3, can effectively achieve THREE operational states. The FIRST operational state is the state wherein, for example, as has just been described, a first one of the electrically controlled, solenoid-actuated control valves 190*a* has been moved to its OPEN position whereby the output of the hot melt adhesive or other thermoplastic material from the dispensing nozzle member 188*a* is the hot melt adhesive or other thermoplastic material supplied by means of supply source S1. The hot melt adhesive or other thermoplastic material is permitted to flow from supply source S1 to the dispensing nozzle member 188*a* as a result of the installation of the plug member 206 within the fifth horizontally oriented output supply passageway 200 defined within the upper left central portion of the output device or applicator 110, all as illustrated within FIG. 3, and the removal of the plug 204 from the fourth horizontally oriented output supply passageway 182 which is defined within the output device or applicator 110 as is also disclosed within FIG. 3. In addition, the pressure relief valve 191*a* has been placed within the bore 210 of the output device or applicator 110, and the pressure relief plug 202 has been placed within the bore 208 of the output device or applicator 110.

The SECOND operational state is the state wherein, for example, as has just been described, the first one of the electrically controlled, solenoid-actuated control valves 190*a* has been moved to its OPEN position, however, the plug member 204 has now been installed within the fourth horizontally oriented output supply passageway 182, and the plug 206 has been removed from the fifth horizontally oriented output supply passageway 200 defined within the upper left central portion of the output device or applicator 110, all as illustrated within FIG. 3. Accordingly, the output of the second hot melt adhesive or other thermoplastic material from the pump 152*a* and the dispensing nozzle member 188*a* is now permitted and facilitated. In addition, the pressure relief valve 191*a* has now been placed within the bore 208 of the output device or applicator 110, and the pressure relief plug 202 has now been placed within the bore 210 of the output device or applicator 110 so as to permit return or recirculation flow of the hot melt adhesive or other thermoplastic material back to the filter block 302 when the electrically controlled, solenoid-actuated control valve 190*a* has been moved to its CLOSED position.

The THIRD operational state is the state wherein, for example, as has just been described, the first one of the electrically controlled, solenoid-actuated control valves 190*a* has been moved to its OPEN position, however, both of the plug members 204, 206 have been removed from their respective output supply passageways whereby both hot melt adhesives or other thermoplastic materials from the supply sources S1, S2 are now able to be conducted toward and dispensed outwardly from the dispensing nozzle member 188*a*. As has been noted, such circumstances can be achieved when it is desired, for example, to dispense a two-part adhesive or other construction material or composition for deposition onto the common substrate. Examples of the latter are a two-part epoxy which may comprise, for example, an adhesive and a catalyst, or a polymer and a foaming agent that can be utilized to form a suitable gasket utilized within refrigeration systems or equipment. It will of course be appreciated that similar operations can be achieved in connection with the gear pumps 150*b*, 152*b*, 150*c*, 152*c*, 150*d*, 150*d*, as well as in connection with their associated dispensing nozzle members 188*b*, 188*c*, 188*d*, the electrically controlled, solenoid-actuated control valves 190*b*, 190*c*, 190*d*, the pressure relief valves 191*b*, 191*c*, 191*d*, and the like. It is likewise to be appreciated that while the description and drawings have only been directed toward the provision of two gear pump assemblies 104, 106 respectively comprising the various gear pumps 150, 152, additional gear pump assemblies, comprising additional gear pumps, can of course be incorporated into the metering system 100, such additional gear pump assemblies, their associated gear pumps, electrically controlled, solenoid-actuated control valves, and relief valves being added to the metering system 100 in order to provide additional hot melt adhesives or other thermoplastic materials as may be desired or required in accordance with predeterminedly required or desired patterns, or at predeterminedly required or desired locations.

With reference reverting back to FIG. 2, it is to be appreciated that an additional operational condition, other than those which have already been described, can be readily achieved in accordance with the principles and teachings of the present invention by means of the metering system 100. More particularly, it is to be recalled that each one of the gear pump assemblies 104, 106 comprises, for example, four gear pumps 150, 152 which are disposed in a side-by-side array with respect to each other as disclosed within FIGS. 1 and 2. For clarity purposes, and to illustrate the additional operational condition of the metering system 100 of the present invention, the four gear pumps of each gear pump assembly 104, 106 have been designated as gear pumps 150*a*, 150*b*, 150*c*, 150*d*, 1252*a*, 152*b*, 152*c*, 152*d*. In addition, each one of the gear pumps 150*a*, 150*b*, 150*c*, 150*d*, 152*a*, 152*b*, 152*c*, 152*d* has operatively associated therewith electrically controlled, solenoid-actuated control valves 190/150*a*, 190/150*b*, 190/150*c*, 190/150*d*, 190/152*a*, 190/152*b*, 190/152*c*, and 190/152*d*, some of which have been illustrated within FIG. 4. It is to be further appreciated that the side-by-side disposition of the gear pumps 150*a*, 150*b*, 150*c*, 150*d*, 152*a*, 152*b*, 152*c*, 152*d* will lead to or enable side-by-side deposits of the hot melt adhesives or other thermoplastic materials from suitable, individual dispensing nozzle members 188/150*a*, 188/150*b*, 188/150*c*, 188/150*d*, 188/1252*a*, 188/152*b*, 188/152*c*, 188/152*d*, some of which have also been illustrated within FIG. 4, onto the underlying product or substrate 154 so as to effectively define side-by-side lanes or longitudinally extending strips 266, 268, 270, 272 of the hot melt adhesives or other thermoplastic materials upon the underlying product or substrate 154.

With reference again being made to FIG. 2, it will be further appreciated that the overall width of a specific type of hot melt adhesive or other thermoplastic material deposited onto the underlying product or substrate 154 can vary, that is, it can extend across two lanes 268, 270 as at 274, it can be relatively narrow so as to effectively occupy only a single lane as disclosed, for example, at 266 or 272, or the different hot melt adhesives or other thermoplastic materials can be deposited within any one or more of the lanes 268, 270, 272, 274 so as to achieve various different or mixed patterns at various different locations upon the product or substrate, all depending upon whether or not a particular one of the gear pumps 150*a*, 150*b*, 150*c*, 150*d*, 152*a*, 152*b*, 152*c*, 152*d* is being utilized, whether or not the output flow of the first or second hot melt adhesive or other thermoplastic material from the supply sources S1, S2, by means of particular ones of the gear pumps 150*a*, 150*b*, 150*c*, 150*d*, 152*a*, 152*b*, 152*c*, 152*d* have been permitted to flow to their respective dispensing nozzle members 188*a*, 188*b*, 188*c*, 188*d* by means of the actuation of the respective electrically controlled, solenoid-actuated control valves 190*a*, 190*b*, 190*c*, 190*d*, and as a result of the predetermined or selected disposition of the plugs 204*a*, 204*b*, 204*c*, 204*d*, 206*a*, 206*b*, 206*c*, 206*d* within the fourth horizontally oriented output supply passageway 182*a*, 182*b*, 182*c*, 182*d*, or the fifth horizontally oriented output supply passageway 200*a*, 200*b*, 200*c*, 200*d* defined within the output device or applicator 110, as well as the placement of the respective pressure relief valves 191*a*, 191*b*, 191*c*, 191*d*, and the respective pressure relief plugs 202*a*, 202*b*, 202*c*, 202*d* within the appropriate bores 208*a*, 208*b*, 208*c*, 208*d*, 210*a*, 210*b*, 210*c*, 210*d*.

Thus, it may be seen that in accordance with the principles and teachings of the present invention, there has been disclosed a new and improved hot melt adhesive or other thermoplastic material dispensing system which comprises the utilization of two separate and independent rotary, gear-type metering pumps with two separate and independent fluid supply passages supplying two separate, different, and independent hot melt adhesives or thermoplastic materials onto a common substrate from a common or shared output device or applicator, or two separate and independent sets of rotary, gear-type metering pumps with two separate and independent fluid supply passages supplying two separate, different, and independent hot melt adhesives or thermoplastic materials, which are adapted to output or discharge precisely metered amounts of two separate and independent hot melt adhesives or other thermoplastic materials onto a common substrate from common or shared output devices or applicators respectively connected to one pump from each set of gear pumps.

Furthermore, the precisely metered amounts of the hot melt adhesives or other thermoplastic materials discharged from the two separate and independent rotary gear-type metering pumps, to which have been supplied two separate, independent, and different hot melt adhesives or other thermoplastic materials, or from the two separate and independent sets of rotary gear-type pumps to which have been supplied two separate, independent, and different hot melt adhesives or other thermoplastic materials, are able to in fact be independently discharged or outputted through suitable output devices or applicators onto a common substrate so as to result in two different adhesives or other thermoplastic materials in accordance with predeterminedly required or desired patterns, or at predeterminedly required or desired locations. Still yet further, the precisely metered amounts of the two separate, independent, and different hot melt adhesives or other thermoplastic materials which have been dispensed from the two separate and independent rotary gear-type pumps, or from the two separate and independent sets of rotary gear-type pumps, may also have their outputs effectively combined such that the discharged or outputted volumes of the hot melt adhesives or other thermoplastic materials from the common or shared output device or applicator effectively form, for example, a two-part adhesive or other construction material or composition for deposition onto the common substrate. Examples of the latter are a two-part epoxy which may comprise, for example, an adhesive and a catalyst, or a polymer and a foaming agent that can be utilized to form a suitable gasket utilized within refrigeration equipment or systems.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States is:

1. A fluid dispensing system, comprising:

a first supply source for supplying a first fluid to be dispensed;

a second supply source for supplying a second fluid to be dispensed wherein the second fluid is different front the first fluid;

an adhesive manifold;

an applicator assembly positioned downstream from, mounted directly to, and disposed in fluid communication with the adhesive manifold and having at least one nozzle member;

first and second pumps removably mounted directly on the adhesive manifold, such that the adhesive manifold is disposed downstream from the first and second pumps and upstream from the applicator assembly, the first and second pumps for pumping the respective first and second fluids from said respective first and second supply sources to said at least one nozzle member through the adhesive manifold;

first and second output supply passageways connecting in the applicator assembly to form a third output supply passageway downstream from, and in fluid communication with, the first and second output supply passageways, to fluidically interconnect said first and second pumps to said at least one nozzle member so as to supply the first and second fluids to said at least one nozzle member;

first and second plug members internally disposed completely within respective first and second output supply passageways at an edge of the applicator assembly where the adhesive manifold abuts the applicator assembly, each plug member movable to an INSTALLED state positioned completely in a respective output supply passageway or a REMOVED state removed from a respective output supply passageway; and the nozzle member is connected to the third output supply passageway through a valve assembly located in the applicator assembly downstream from said first and second plug members and the first and second output supply passageways, and upstream from said at least one nozzle member, said valve assembly includes a valve for permitting said fluid dispensing system to achieve THREE dispensing states, a FIRST state wherein said valve is OPENED, said first plug member is REMOVED from said first output supply passageway to permit the first fluid to be dispensed from said first pump and out from said at least one nozzle member, and said second plug member is INSTALLED in said second output supply passageway, a SECOND state wherein said valve is OPENED, said first plug member is INSTALLED in said first output supply passageway, and said second plug member is REMOVED from said second output supply passageway to permit the second fluid to be dispensed from said second pump and out from said at least one nozzle member, and a THIRD state wherein said valve is OPENED and said first and second plug members are REMOVED from said first and second output supply passageways, respectively, to permit both of the first and second fluids to be dispensed from said first and second pumps and out from said at least one nozzle member.

2. The fluid metering system as set forth in claim 1, wherein:

said first and second pumps of said at least two pumps are disposed within a single pump assembly.

3. The fluid metering system as set forth in claim 1, wherein:

said first and second pumps are disposed within separate first and second pump assemblies.

4. The fluid metering system as set forth in claim 1, wherein:

said valve comprises an electrically controlled, solenoid-actuated control valve.

5. The fluid metering system as set forth in claim 1, wherein:

said first and second pumps comprise rotary gear metering pumps for outputting metered amounts of the first fluid and/or the second fluid to be dispensed.

6. The fluid metering system as set forth in claim 3, wherein:

each of said first and second pump assemblies comprises four pumps disposed in a side-by-side array.

7. The fluid metering system as set forth in claim 6, wherein:

said at least one nozzle member comprises four nozzle members disposed in a side-by-side array and respectively fluidically connected to said four pumps of each one of said separate first and second sets of pumps so as to dispense the first fluid and/or the second fluid onto a substrate in longitudinally extending strips as the substrate passes said four dispensing nozzle members.

8. The fluid metering system as set forth in claim 7, wherein:

said longitudinally extending strips of said first fluid and/or said second fluid, dispensed onto the substrate can comprise either one of the first and second fluids depending upon which one of said pumps are permitted to output its fluid to its respective nozzle member such that different patterns of the first and/or second fluids can be deposited upon the substrate and at different locations thereof.

9. The fluid metering system as set forth in claim 3, wherein:

said first and second pump assemblies are fixedly, but removably mounted upon the adhesive manifold.

10. A fluid dispensing system comprising:

a first supply source for supplying a first fluid to be dispensed;

a second supply source for supplying a second fluid to be dispensed wherein the second fluid is different from the first fluid;

an adhesive manifold;

a first gear pump assembly removably mounted directly on the adhesive manifold, the first gear pump assembly configured to pinup a first fluid to the adhesive manifold;

a second gear pump assembly removably mounted directly on the adhesive manifold, the second gear pump assembly configured to pump a second fluid to the adhesive manifold;

an applicator assembly mounted directly on, in abutting relationship with, and downstream from, the adhesive manifold, such that the adhesive manifold is disposed between the applicator assembly and the first gear pump assembly and the second gear pump assembly;

a nozzle member disposed on the applicator assembly;

a first output supply passageway fluidically connected to and configured to receive the first fluid from the first gear pump assembly, the first output supply passageway extending through the adhesive manifold and into the applicator assembly;

a second output supply passageway fluidically connected to and configured to receive second fluid from the second gear pump assembly, the second output supply passageway extending through the adhesive manifold and into the applicator assembly;

a third output supply passageway fluidically connected to the first and second output supply passageways in the applicator assembly and configured to receive one of the first fluid from the first output supply passageway or the second fluid from the second output supply passage, or both of the first fluid and the second fluid from the first output supply passageway and second output supply passageway, respectively, the third output supply passageway extending in the applicator assembly and fluidically connecting the first and second output supply passageways with the nozzle member;

a first plug member removably disposed in the first output supply passageway at an edge of the applicator assembly where the adhesive manifold abuts the applicator assembly, movable to an INSTALLED position preventing the first fluid from flowing to the third output supply passageway or a REMOVED position allowing the first fluid to flow to the third output supply passageway;

a second plug member removably disposed in the second output supply passageway at an edge the applicator assembly where the adhesive manifold abuts the applicator assembly, movable to an INSTALLED position preventing the second fluid from flowing to the third output supply passageway or a REMOVED position allowing the second fluid to flow to the third output supply passageway; and the nozzle member is connected to the third output supply passageway by a valve assembly located in the applicator assembly downstream from the first output supply passageway and second output supply passageway and upstream flour the nozzle member, the valve actuatable between an OPENED position and a CLOSED position to selectively permit or prevent the first fluid and/or the second fluid to flow to the nozzle member for discharge.

* * * * *